United States Patent [19]

Lee

[11] Patent Number: 4,858,969

[45] Date of Patent: Aug. 22, 1989

[54] DOOR LATCH ASSEMBLY

[75] Inventor: Kwan H. Lee, Changwon, Rep. of Korea

[73] Assignee: Gold Star Co., Ltd., Seoul, Rep. of Korea

[21] Appl. No.: 90,330

[22] Filed: Aug. 28, 1987

[51] Int. Cl.[4] ..... E05C 3/22

[52] U.S. Cl. ..... 292/78; 292/216; 292/DIG. 61

[58] Field of Search ..... 292/78, 201, 216, DIG. 61

[56] References Cited

U.S. PATENT DOCUMENTS

| | | | |
|---|---|---|---|
| 1,263,128 | 4/1918 | Schomo | 292/78 |
| 2,790,665 | 4/1957 | Vanderweld | 292/78 X |
| 3,115,358 | 12/1963 | Bugge | 292/78 |
| 4,497,513 | 2/1985 | Sasaki | 292/78 X |
| 4,687,237 | 8/1987 | Bisbing | 292/78 |

*Primary Examiner*—Peter R. Brown

*Attorney, Agent, or Firm*—Rosen, Dainow & Jacobs

[57] ABSTRACT

A door latch assembly for use in a microwave oven comprises a latch pawl secured to the inside of the door, a revolving plate having integrally molded therewith a push projection, a hook-shaped projection having a stop surface formed thereon, a projected bar and a U-shaped spring support member having a panel spring positioned longitudinally therein. The stop surface of the hook-shaped projection prevents further rotation of the revolving plate by abutting the surface of the spring support member.

10 Claims, 3 Drawing Sheets

DOOR LATCH ASSEMBLY

FIELD OF THE INVENTION

This invention relates to a latch assembly and particularly to the improvements in a latch assembly used in a microwave oven.

BACKGROUND OF THE INVENTION

A known latch assembly used in a microwave oven has customarily comprised a plurality of component parts for assuring that there is very little leakage of the microwave energy during operation of the oven. The construction of latch assembly necessitated the high cost because of the expensive component parts of it.

This latch assembly has numerous disadvantages inclusive of the following: it is easily unlatched by some shocks to the oven; there is looseness therein; and it requires a considerable manual force to push the button accessible from outside of the oven to open the door of the microwave oven.

SUMMARY OF THE INVENTION

An object of this invention is to provide a latch assembly that operates easily and effectively without using a separate push-button with a minimum of manipulation and manual force.

A further object of this invention is to provide a latch assembly for assuring that a door is properly closed so that there is no leakage of the microwave energy during operation of the oven.

A still further object of the present invention is to provide a latch assembly for use in a microwave oven, which can be easily constructed with a low cost by virtue of simple construction.

In accordance with the objects of this invention the latch assembly comprises a latch pawl secured to the inside of the door, a spring support member abutting against the front face of the microwave oven and having two grooves at inner ends for receiving both ends of a panel spring, a revolving plate having integrally molded therewith a push projection pushing the panel spring, a hook-shaped projection having a stop surface preventing further rotation of the revolving plate and a projected bar for actuating a switch.

BRIEF DESCRIPTION OF THE DRAWINGS

The manner in which the foregoing and other objects of this invention are accomplished will be apparent from the accompanying specification and claims considered together with the drawings, wherein:

FIG. 2-B is similar to FIG. 2-A but in the unlatched position;

DETAILED DESCRIPTION OF THE INVENTION

Figure 1:
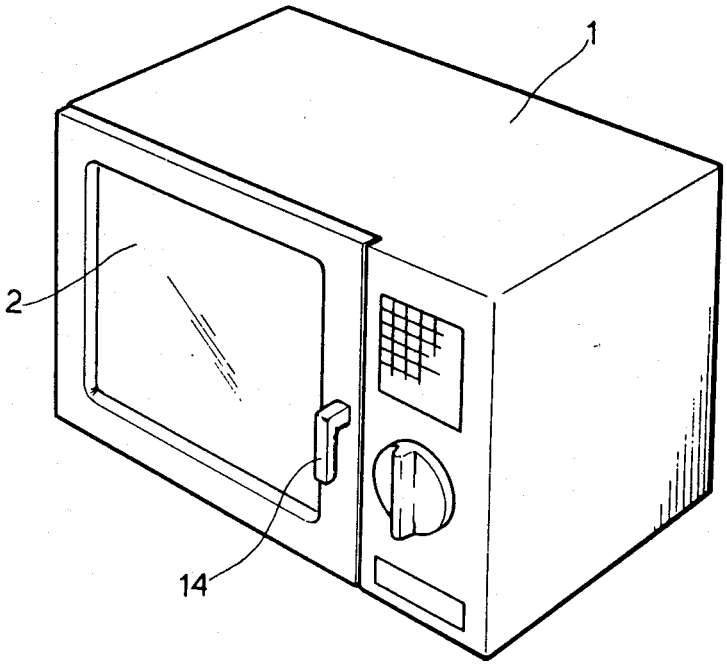
FIG. 1 is a perspective view of a microwave oven to which the present invention is applicable.
Figure 2B:
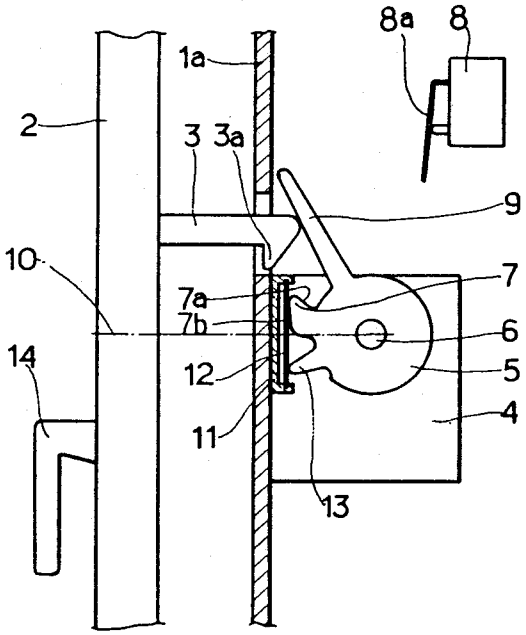
FIG. 2-A is a side elevational view of the latch assembly of the present invention in the latched position.
Figure 2A:
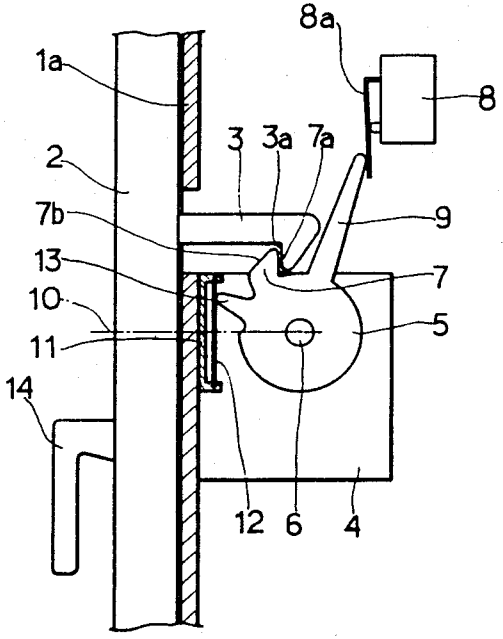

A microwave oven to which the present invention is applicable is shown in FIG. 1 and comprises an outer casing or housing 1 and a door 2 hinged at one end thereof and having a handle 14 at the other end, the door pivotable between open state, near-closed state, as seen in FIG. 2B, and fully closed state, as seen in FIG. 2A.

Figure 4:
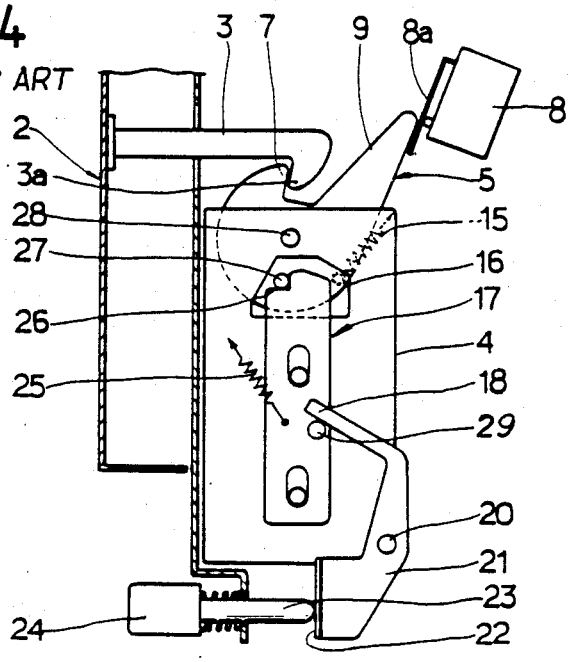
FIG.4 PRIOR ART
FIG. 4 is a side view of a known latch assembly in a latched position.

The latch assembly may comprise as shown in FIG. 4 a latch pawl 3 having a downwardly depending hook projection 3*a* secured to the inside of the door 2 which is received through the front face 1*a* when the door 2 is in its closed position. Behind and attached to the front face 1*a* is a rectangular support member 4 having a trapezoid-shaped hole 16. An upward and downward movable lever 17 having a cut-out portion 26 on which a support pin 27 will be hanged is mounted on the support member 4. A rotatable lever 21 pivotally secured by a shaft 20 has one end 22 contacted with an actuator bar 23 and the other end 18 placed over a support pin 29 secured to the movable lever 17. A coil spring 25 is slantingly located between the support member 4 and the movable lever 17. An actuator lever 21 is pivotally mounted by a shaft 20. A revolving plate 5 having a hook-shaped portion 7 and a projecting bar 9 is pivotally mounted by a shaft 28 on the support member 4. A coil spring 15 is slantingly positioned between the revolving plate 5 and the support member 4. A stop pin 27 secured to the inside of the outer casing 1 is hanged on the cut-out portion 26 of the lever 17.

In the prior art embodiment illustrated, upon pushing the push-button 24 for moving the latch 3 to an unlatching position the rotatable lever 21 will push the support pin 29 downwardly causing the up and down movable lever 17 to move downwardly, thereby the stop pin 27 will be removed from the cut-out portion 26 and then the revolving plate 5 will rotate anti-clockwise by the force applied by the spring 15, and consequently the latch pawl 3 will move to its unlatching position.

The known latch assembly described in the above has some disadvantages which has previously been described. Accordingly, this invention discloses and claims a variation of such known latch assembly to overcome such disadvantages.

Figure 3:
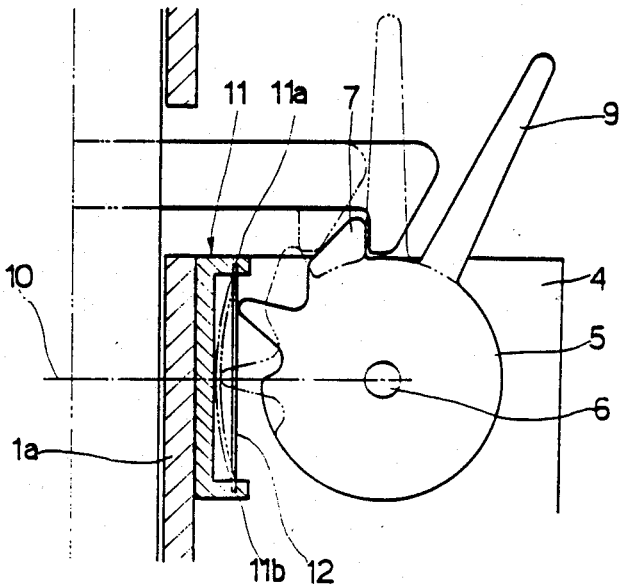
FIG. 3 is a side view of some portions of the latch assembly on an enlarged scale.

In FIG. 2-A, the latch pawl 3 and the projected bar 9 perform generally the same functions as before, the pawl having a push part for engaging bar 9. However, there are provided a spring support member 11 abutting against the front face 1*a* and a push projector or first part 13 integrally molded with the revolving plate 5. The spring support member 11 as clearly shown in FIG. 3 has opposing grooves 11*a*, 11*b* formed therein into which a longitudinally positioned panel spring 12 is inserted at each end thereof. The revolving plate 5 having integrally molded therewith three members is rotatably mounted on the rectangular support member 4 by a shaft 6.

When the latch pawl 3 is in its latched or fully closed position as shown in FIG. 2-A the latch pawl 3 engages with the hook-shaped projection or second part 7 of the revolving plate 5 with the downwardly depending hook projection 3*a*. When they are so engaged there is in effect no slack or looseness in the latch assembly and the downwardly depending hook projection 3*a* engages with the hook-shaped portion 7*a* causing the push projection 13 to depress or deflect the upper part of the panel spring 12 and the projected bar or third part 9 to depress the actuator arm 8*a* that actuates a switch 8. The center 10 of the panel spring 12 is aligned with the axis of the shaft 6.

The force of the panel spring 12 rotates the revolving plate 5 clockwise about the shaft 6 and then the hook-shaped projection 7 pushes the latch pawl 3 toward the downwardly depending hook projection 3*a* which causes the door 2 to be in its fully closed position such that there is no leakage of the microwave energy during the operation of the oven.

Referring now to FIG. 2-B, upon pulling the handle 14 by the user the latch pawl 3 pulls the hook-shaped projection 7 forwardly causing the revolving plate 5 to rotate anti-clockwise about the shaft 6 and the push projection 13 to be moved downwards. Upon continued movement of the latch pawl 3 to its fully unlatched position the projected bar 9 pushes the latch pawl 3 and thus the push projection 13 pushes the lower part of the panel spring 12. It will be understood that force applied by the spring will be overcome by a stop surface 7*b* of the push projection 7. The stop surface 7*b* prevents further anti-clockwise movement of the revolving plate 5 by abutting to the one surface of the spring support member 11. Pushing of the door allows the latch pawl 3 and the projected bar 9 to be moved inwardly and the latch pawl 3 returns to its latched position as shown in FIG. 2-A.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. In a door latch assembly for use in a microwave oven having a door, the door latch assembly comprising a latch pawl fastened inside the door, a support member secured to a front face of the oven at one end thereof, a revolving plate pivotally mounted on the support member and having a hook-shaped portion and a projected bar for use in actuating a switch, the improvement comprising:

a spring support member secured to said front face of said microwave oven;

a panel spring secured to said spring support member for pivotally urging said revolving plate;

said revolving plate having a push projection acted on by the panel spring for urging the revolving plate in a first direction such that the hook-shaped portion thereof engages said latch pawl in a closed condition of said door; and said hook-shaped projection of said revolving plate having a stop surface acted on by said panel spring for limiting movement of said revolving plate in a second direction opposite said first direction in an open condition of said door.

2. The latch assembly according to claim 1 wherein said spring support member is U-shaped and includes oppositely disposed grooves therein which receive opposite ends of said panel spring therein to secure said panel spring in said spring support member.

3. The latch assembly according to claim 1 wherein said support member is rectangularly shaped.

4. The latch assembly according to claim 1 wherein said panel spring is flat when unstressed.

5. In a door latch assembly for use in a microwave oven having a housing, a door mounted to said housing and pivotable between open, near closed and fully closed states, and an electrical switch mounted in said housing, the door latch assembly including a pawl extending from the door inward into said housing when said door is in near closed and fully closed states, the improvement wherein said pawl has a hook part and a push part, the improvement further comprising a spring mounted to said housing and a latch means mounted to said housing and pivotable between open and closed states, said latch means having a first part for engaging said spring which biases said latch means to pivot to said either closed or open states, a second part for releasably engaging said hook part of said pawl, and a third part for releasably engaging said switch, said pawl oriented for its push part to engage said latch means third part and pivot said latch means when the door is pivoted from its open to its near closed state, said door latch assembly being operable when said door is pivoted to its near closed state and pivots said latch means, such that said spring urges said first part which urges said latch to further rotate to its closed state, said second part engages said hook part of the pawl such that pivoting of said latch means to its closed state pulls said pawl and door to its fully closed state, and said third part is thus pivoted to engage and actuate said switch, said door latch assembly further operable when said door is pulled from its fully closed state toward its near closed state such that said hook part of the pawl pulls the second part of the latch means and pivots said latch means, thus causing said third part to release said switch and said first part to be biased by said spring to further pivot, whereby said third part pushes said pawl's push part which further opens said door, said latch means further comprising a stop surface for engaging the housing to stop said latch means in its open state.

6. A door latch assembly according to claim 5 wherein said stop surface of said latch means is on said second part.

7. A door latch assembly according to claim 5 wherein said first, second and third parts of said latch means extend generally radially outward relative to the pivot axis of said latch means.

8. A door latch assembly according to claim 5 wherein said spring comprises a panel spring oriented generally perpendicular to said latch means.

9. A door latch assembly according to claim 5 wherein said panel spring is generally flat when unstressed, and is deflectable when engaged by said first part of said latch means.

10. A door latch assembly according to claim 5 further comprising a support member on said housing, said support member adapted to hold said spring and allow said spring to be deflected by said latch member's first part.

* * * * *